US008403687B2

(12) United States Patent
Abe et al.

(10) Patent No.: US 8,403,687 B2
(45) Date of Patent: Mar. 26, 2013

(54) DATA STORAGE DEVICE AND PRINTING APPARATUS INCLUDING THE SAME

(75) Inventors: Tsukasa Abe, Asahi-mura (JP); Koichiro Komatsu, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 293 days.

(21) Appl. No.: 12/949,329

(22) Filed: Nov. 18, 2010

(65) Prior Publication Data

US 2011/0136357 A1 Jun. 9, 2011

(30) Foreign Application Priority Data

Dec. 4, 2009 (JP) ..... 2009-276145

(51) Int. Cl.
*H01R 13/44* (2006.01)

(52) U.S. Cl. ..... 439/133; 439/137; 439/141

(58) Field of Classification Search ..... 439/133, 439/135, 137, 141, 144–146, 928.1
See application file for complete search history.

(56) References Cited

U.S. PATENT DOCUMENTS 5,603,623 A * 2/1997 Nishikawa et al. ..... 439/144
6,154,597 A * 11/2000 Roth ..... 385/139
6,195,589 B1 * 2/2001 Ketcham ..... 700/28
6,377,451 B1 * 4/2002 Furuya ..... 361/679.32
7,073,717 B1 * 7/2006 Arnold et al. ..... 235/472.01
7,104,817 B2 * 9/2006 Shiue et al. ..... 439/137
2011/0169385 A1 * 7/2011 Watanabe et al. ..... 312/223.2

FOREIGN PATENT DOCUMENTS

JP 2003-150911 A 5/2003
JP 2005-119120 A 5/2005
JP 2005-174457 A 6/2005
JP 2007-024291 A 2/2007
JP 2007-290199 A 11/2007
JP 2009-224088 A 10/2009

* cited by examiner

*Primary Examiner* — Xuong Chung Trans
(74) *Attorney, Agent, or Firm* — Nutter McClennen & Fish LLP; John J. Penny, V.

(57) ABSTRACT

A data storage device is provided. At least a storage section configured to store information therein and a connection terminal configured to transmit information are mounted on a substrate. A casing accommodates the substrate, the casing is formed with an opening to expose a connection portion of the connection terminal to the outside. A shield plate configured to shield the opening of the casing. A shield plate actuation mechanism is configured to detect a connection state between the connection terminal and a receiving terminal to which the connection terminal is connected and actuate the shield plate. The shield plate actuation mechanism actuates the shield plate to shield the opening when the shield plate actuation mechanism detects that the connection terminal is separated from the receiving terminal.

4 Claims, 10 Drawing Sheets

DATA STORAGE DEVICE AND PRINTING APPARATUS INCLUDING THE SAME

The disclosure of Japanese Patent Application No. 2009-276145 filed on Dec. 4, 2009, including specification, drawings and claims are incorporated herein by reference in its entirety.

BACKGROUND

The present invention relates to a data storage device which stores data regarding accounting in the field of sales, logistics, commercial distribution, and the like, and a printing apparatus including the data storage device.

In the field of sales, logistics, and commercial distribution, various systems (a POS system and the like) are used which process accounting information. In such a system, a printer is used as a printing apparatus so as to record and issue accounting information. As this type of printer, there is a so-called fiscal printer. The fiscal printer includes a printing main body section which records and issues accounting information, and a data storage device which stores the recorded accounting information. Data which is stored in the data storage device relates to, for example, tax and is used to secure taxation.

Thus, it is desirable that the data storage device has a structure in which data based on accounting information cannot be falsified. For this reason, it is necessary to prevent disconnection of a substrate or a memory for data falsification or unauthorized access to data. A sealed structure is proposed in which a substrate, on which an electronic component such as a memory for storing data is mounted, is accommodated in a cover (casing), a wire is locked to a screw fastening the cover, and the wire is sealed (for example, see Patent Document 1).

Patent Document 1: JP-A-2007-24291

In recent years, a data storage device is accommodated in a casing and managed with a unique number as a single product. This type of data storage device is detachably attached to a fiscal printer main body section by connection terminals or the like. For this reason, it is anticipated that the data storage device will be unauthorizedly disconnected for data falsification or unauthorized access to data. Accordingly, there is a demand for retaining the history and trace of disconnection, making it impossible for unauthorized access to an electronic component, such as a memory, and making it impossible for reconnection after data falsification.

SUMMARY

It is therefore an object of at least one embodiment of the present invention to solve at least one of the above-described problems and the present invention can be implemented as the following aspects or application examples.

In order to achieve at least one of the above-described objects, according to a first aspect of the embodiments of the present invention, there is provided a data storage device, comprising: a substrate on which at least a storage section configured to store information (data) therein and a connection terminal configured to transmit information are mounted; a casing accommodating the substrate, the casing formed with an opening to expose a connection portion of the connection terminal to the outside; a shield plate configured to shield the opening of the casing; and a shield plate actuation mechanism configured to detect a connection state between the connection terminal and a receiving terminal to which the connection terminal is connected and actuate the shield plate, wherein the shield plate actuation mechanism actuates the shield plate to shield the opening when the shield plate actuation mechanism detects that the connection terminal is separated from the receiving terminal.

With this structure, when the data storage device is disconnected, that is, when the connection terminal of the data storage device is separated from the receiving terminal, the shield plate which is actuated by the shield plate actuation mechanism can shield a part or the entire part of the opening which exposes the connection portion of the connection terminal. For this reason, it is possible to prevent unauthorized access from a terminal section of the connection terminal. The disconnection is found because the opening is shielded, and reconnection to the receiving terminal is impossible. For this reason, it is possible to prevent illegality.

In the data storage device, the shield plate actuation mechanism may include: the shield plate; an urging member that urges the shield plate in one direction; a first shield plate locking member that locks the movement of the shield plate; and a second shield plate locking member that releases locking of the first shield plate locking member and locks the movement of the shield plate when the shield plate actuation mechanism detects that the connection terminal is separated from the receiving terminal.

In the data storage device, the second shield plate locking member may be provided at a side of the receiving terminal.

With this structure, when the data storage device is in an initial state, that is, in a state where the connection terminal of the data storage device is not connected to the receiving terminal, the shield plate is locked to the first shield plate locking means, and the connection terminal of the opening is exposed without being shielded. If it is detected that the connection terminal of the data storage device is connected to the receiving terminal, the locking of the first shield plate locking means is released, and the shield plate which is urged by the urging means is locked by the second shield plate locking means on the receiving terminal side. If the connection terminal and the receiving terminal are separated from each other, the second shield plate locking means provided on the receiving terminal side is separated and the urged shield plate is unlocked. For this reason, the shield plate can shield the opening.

According to a second aspect of the embodiments of the present invention, there is provided a printing apparatus, comprising: a printing section configured to print the information on a recording sheet; a main body section including at least the printing section; and the above-described data storage device, wherein the main body section has the receiving terminal and the data storage device is connected to the printing apparatus through the connection terminal and the receiving terminal.

With this configuration, the printing apparatus can print information (accounting information) and store necessary information in a memory. When the data storage device is unauthorizedly disconnected, the connection terminal section is shielded, reducing unauthorized access and data falsification. Reconnection is impossible, suppressing illegality.

In the printing apparatus, the data storage device may further comprise a control section configured to control the main body section, inside the casing.

With this configuration, the data storage device has the storage section, such as a memory, and the control section of the printing apparatus main body section. That is, printing is impossible in a state where the memory is separated. For this reason, necessary information in accounting information issued as a receipt can be accurately stored in the memory.

DETAILED DESCRIPTION OF THE EMBODIMENTS

Figure 1:
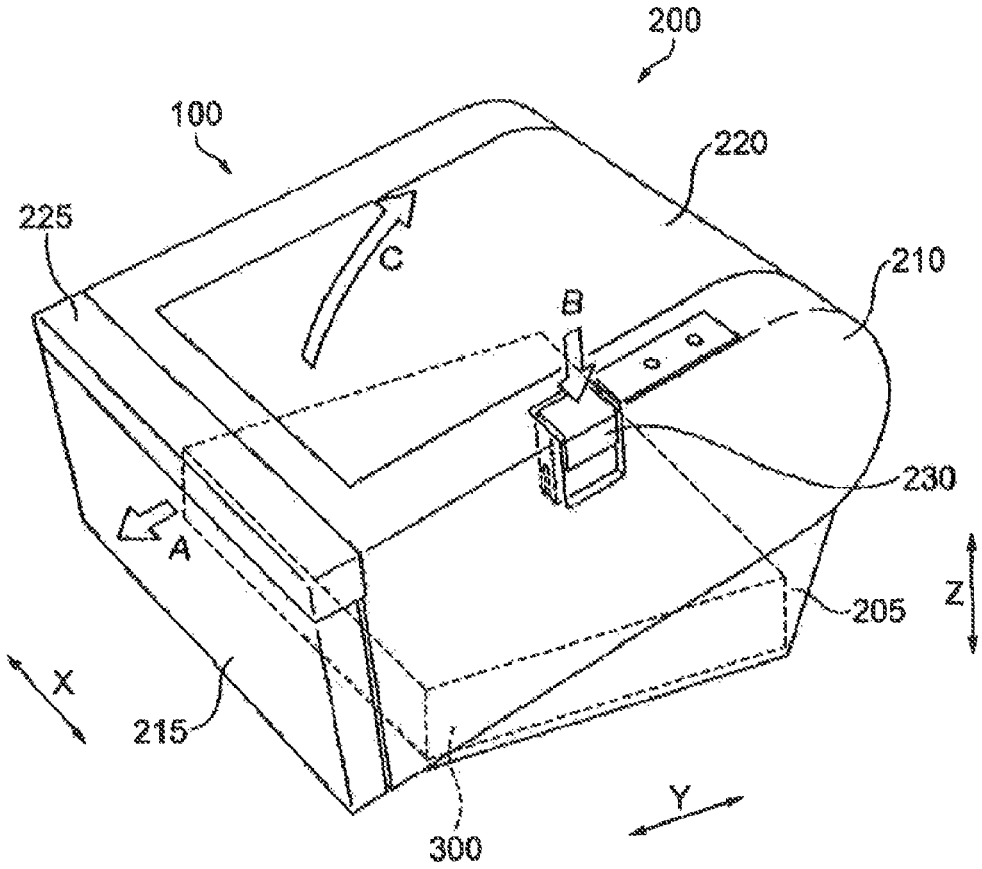
FIG. 1 is a perspective view showing the exterior configuration of a thermal printer.

Hereinafter, this embodiment will be described with reference to the drawings. In the drawings related to the following description, for convenience of description and drawing, the horizontal and vertical scale of each member or portion may be different from the actual scale.

(Overall Configuration of Printing Apparatus)

Figure 2:
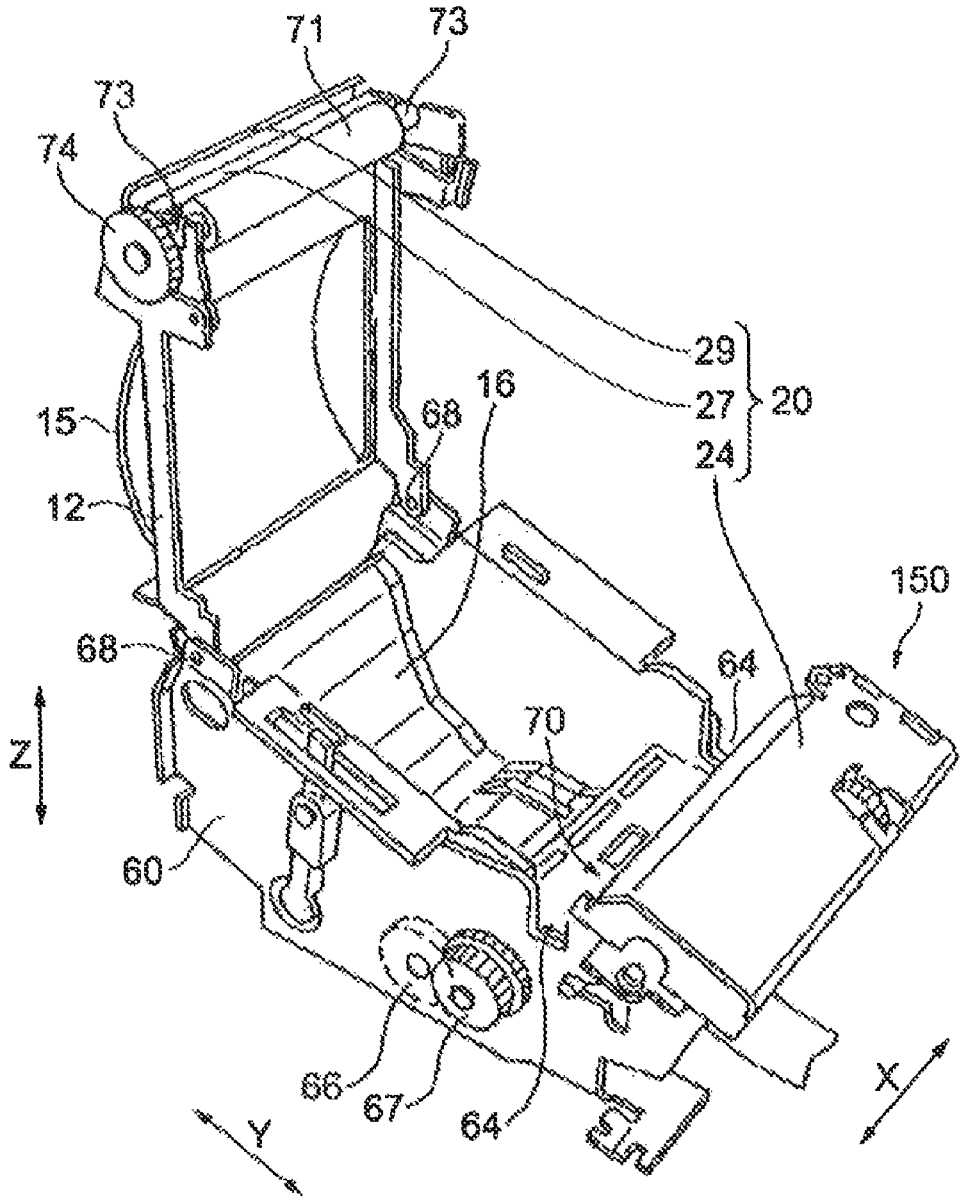
FIG. 2 is a perspective view of a printer mechanism section in a state where a cover frame is open.
Figure 3:
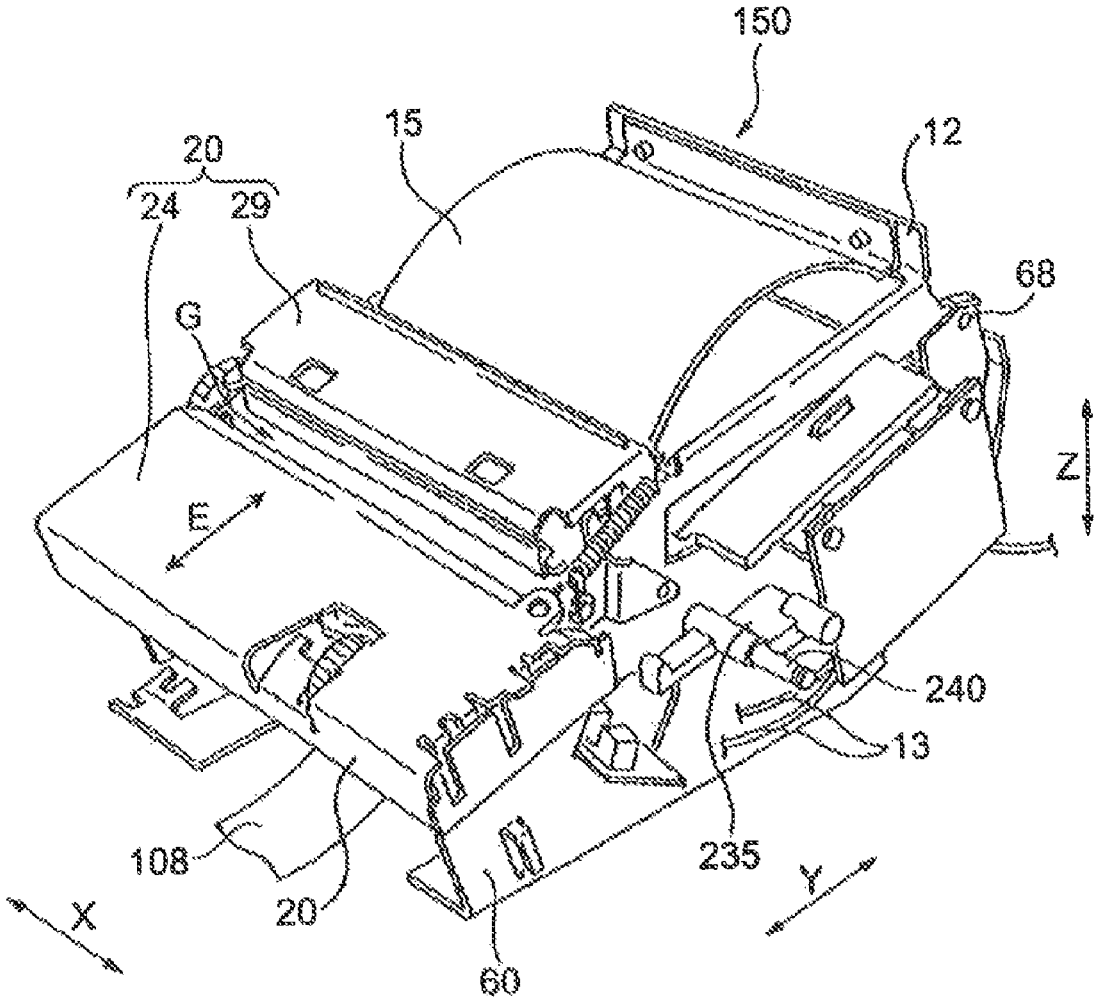
FIG. 3 is a perspective view of the printer mechanism section in a state where the cover frame is closed.
Figure 4:
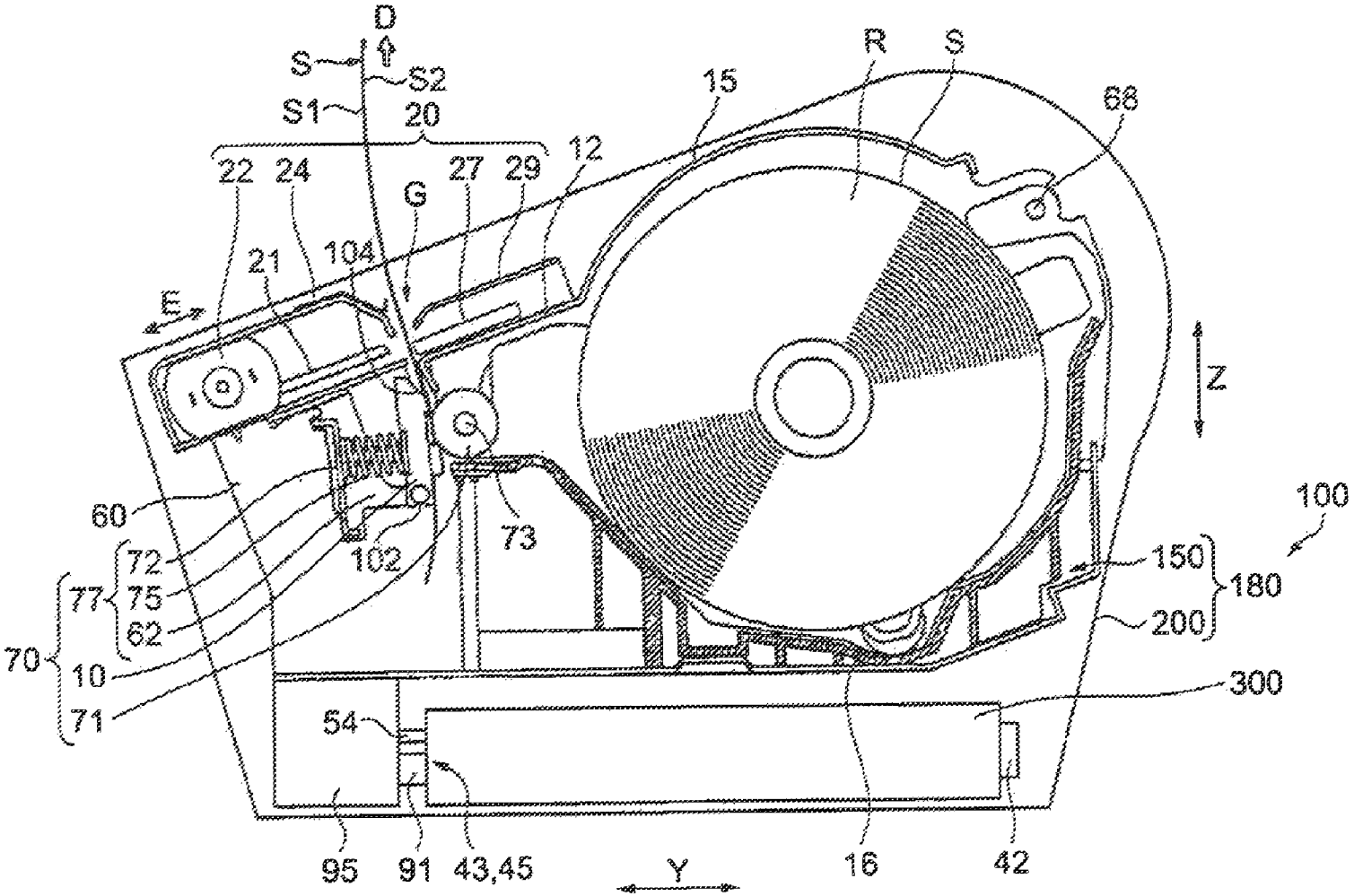
FIG. 4 is a schematic side sectional view of the thermal printer.

As a printing apparatus of this embodiment, for example, a thermal printer will be described with reference to FIGS. 1 to 4. FIG. 1 is a perspective view showing the exterior configuration of a thermal printer. FIGS. 2 and 3 are perspective views showing the exterior of a printer mechanism section. Specifically, FIG. 2 is a perspective view of the printer mechanism section in a state where a cover frame is open. FIG. 3 is a perspective view of the printer mechanism section in a state where the cover frame is closed. FIG. 4 is a side sectional view of the thermal printer.

The thermal printer is used as a fiscal printer which is used to print and issue accounting information on a receipt or the like and to store the accounting information as data. The thermal printer uses a roll-shaped thermal sheet as a recording sheet, and prints and issues the accounting information on the thermal sheet. From the accounting information, for example, information regarding tax is stored in a fiscal memory as fiscal data. In FIGS. 1 to 4, the X direction represents the width direction of the thermal sheet to be printed, the Z direction represents the sheet feed direction of the thermal sheet in a thermal head section serving as a printing head, and the Y direction represents the direction orthogonal to the X direction and the Z direction.

As shown in FIG. 4, a thermal printer 100 includes a printer main body section 180 serving as a printing apparatus main body section and a data storage device 300. The printer main body section 180 includes a printer mechanism section 150 and an exterior case 200. The data storage device 300 described below is detachably connected to the printer main body section 180.

The printer mechanism section 150 shown in FIGS. 2 to 4 is accommodated in the exterior case 200 shown in FIG. 1. Specifically, the printer mechanism section 150 is fixed at the upper part of a lower case 205 made of resin or the like. The lateral surface portion and the rear portion of the printer mechanism section 150 are covered with an upper case 210, and the front portion of the printer mechanism section 150 in the Y direction is covered with a panel 215. The top surface of the printer mechanism section 150 is covered with an upper cover 220. The data storage device 300 is arranged at the lower part of the lower case 205 through an internal connection terminal 43 and a connector 91 serving as a receiving terminal.

As shown in FIG. 1, an open button 230 is provided on one side in the X direction of the top surface of the upper case 210. The open button 230 is depressed in the direction indicated by an arrow B of FIG. 1, such that a cover open lever 235 provided in the printer mechanism section 150 of FIG. 3 can be rotated around a fulcrum 240. The cover open lever 235 is combined with a locking mechanism of a cover frame 12 shown in FIG. 2 and rotates in the clockwise direction such that the locking mechanism is released. The cover frame 12 is combined with the upper cover 220. For this reason, the upper cover 220 is opened in the direction of an arrow C, such that a roll sheet holder 16 is exposed. That is, this state is the state shown in FIG. 2 where the cover frame 12 of the printer mechanism section 150 is open. Thus, a roll-shaped thermal sheet S can be set or ejected.

The thermal sheet S which is used in this embodiment is a roll-shaped thermal sheet S in which a printing surface has a coloring layer with a coloring agent held by a binder or the like, and the printing surfaces are sequentially laminated on the outer surface. Hereinafter, the roll-shaped thermal sheet is called a roller sheet R.

(Overall Configuration of Printer Mechanism Section)

Figure 5:
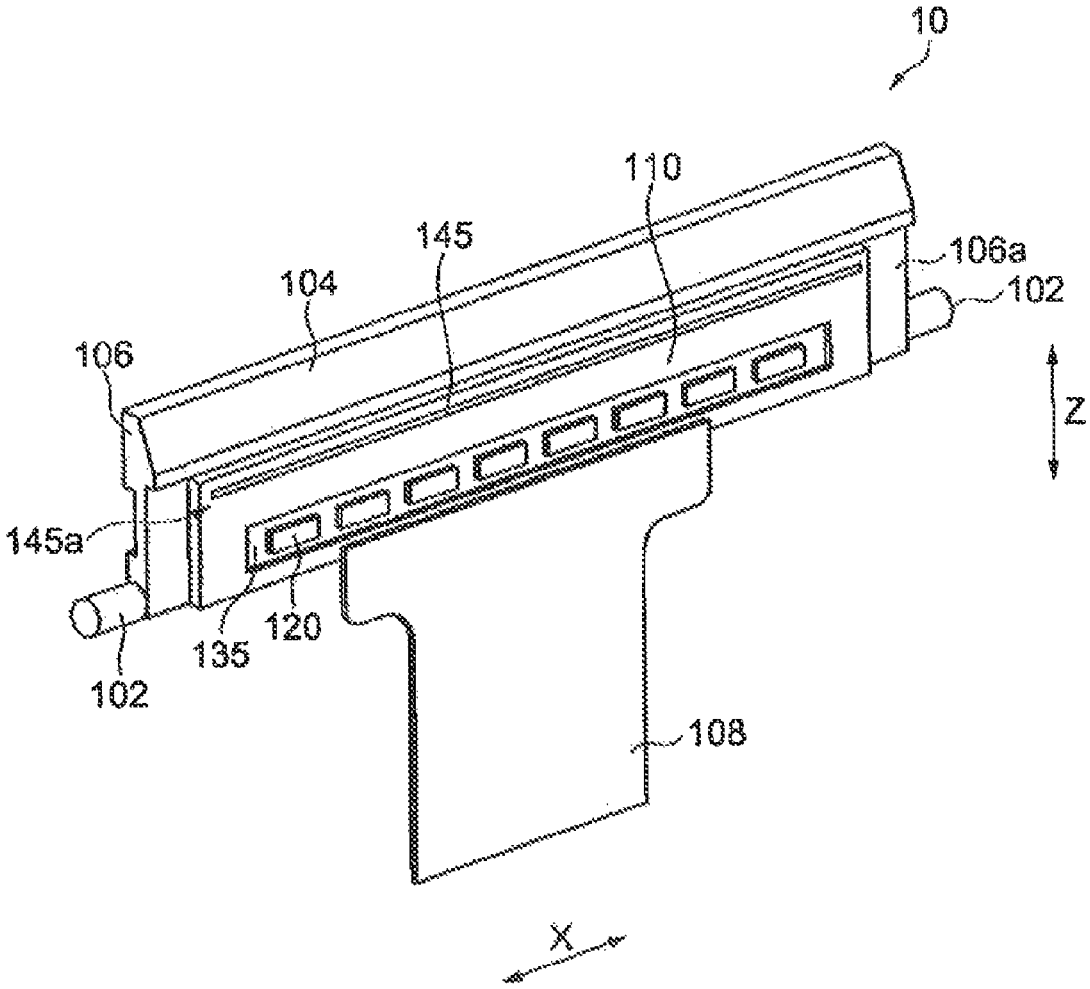
FIG. 5 is an exterior perspective view of a thermal head.

The details of the printer mechanism section will be described with reference to FIGS. 2 to 5. FIG. 5 is an exterior perspective view of a thermal head. The X direction and the Z direction shown in FIG. 5 are respectively the same as the X direction and the Z direction shown in FIGS. 1 to 4. As shown in FIGS. 2 to 4, the printer mechanism section 150 includes a main body frame 60, the cover frame 12, the roll sheet holder 16, a cutter section 20, and a printing section 70.

As shown in FIG. 2, the main body frame 60 is formed of sheet metal or the like in a substantially box shape having openings upward in the Z direction and forward in the Y direction. The cover frame 12 is provided at the upper rear part of the main body frame 60. The cover frame 12 is attached to be openable around support shafts 68 provided at the upper ends on both sides of the rear part of the main body frame 60. The cover frame 12 is provided with an arc-shaped cover 15 for avoiding contact with the roller sheet R when the cover frame 12 is closed. When the installation angle of the thermal printer 100 is changed, that is, when the thermal printer 100 is placed longitudinally, the cover 15 also functions as a holding member which receives the roll sheet R.

As shown in FIG. 2, the roll sheet holder 16 is provided to be covered with the cover frame 12 at the rear of the boxlike inside of the main body frame 60. The roll sheet holder 16 has a substantially arc-shaped dent corresponding to the maximum diameter of the roll sheet R at its central portion. The roller sheet holder 16 is attached at the bottom of the main body frame 60 such that the lateral opening of the arc-shaped dent turns toward both lateral surfaces of the main body frame 60. Both later portions inside the main body frame 60 function as lateral guide portions of the roll sheet R. For this reason, the roll sheet R is set such that the movement of the lateral surface in the width direction is regulated by both lateral portions inside the main body frame 60, and the roller sheet R is rotatably held in the substantially arc-shaped dent of the roll sheet holder 16.

(Cutter Section)

As shown in FIG. 4, the cutter section 20 is provided in front of the main body frame 60, that is, in the vicinity of a sheet outlet port G at a position opposite the support shafts 68 of the cover frame 12. The cutter section 20 includes a movable blade 21, driving means 22 for the movable blade 21, and a fixed blade 27. The movable blade 21 and the driving means 22 are accommodated in a first cutter cover 24 and arranged on the main body frame 60 side. The movable blade 21 is reciprocated by the driving means 22 in the direction of an arrow E in the drawing. The fixed blade 27 is accommodated in a second cutter cover 29 and arranged on the cover frame 12 side, that is, on the side opposite the cover frame 12 with a transport path, through which the thermal sheet S passes, interposed between the fixed blade 27 and the cover frame 12. For this reason, in a state where the cover frame 12 is closed, the blade portion of the movable blade 21 which is reciprocated by the driving means 22 and the blade portion of the fixed blade 27 slide in a state of being in contact with each other. Thus, the thermal sheet S is cut in the vicinity of the sheet outlet port G.

(Printing Section)

As shown in FIG. 4, the printing section 70 is provided in the vicinity of an outlet port on a transport path D of the thermal sheet S with the roll sheet holder 16 as a start point and the sheet outlet port G of the cutter section 20 as an end point. The printing section 70 has the thermal head 10, a head holding mechanism 77, and a platen 71. The thermal head 10 and the head holding mechanism 77 are provided on the main body frame 60 side and the platen 71 is provided on the cover frame 12 side in a state of being separable.

As shown in FIG. 5, the thermal head 10 has a heat release plate 106, a head support shaft 102, a head substrate 110 serving as a substrate, driver ICs 120, and an FPC 108. The head substrate 110 has a rectangular shape in which a heat generation element array 145*a* having a plurality of heat generation elements 145 is formed in the upward Z direction of the drawing along the longitudinal direction. A plurality of driver ICs 120 are provided in parallel to the heat generation element array 145*a* to drive the heat generation elements 145. The heat release plate 106 is formed of a drawn material, such as aluminum. The head substrate 110 is adhered to a locking surface 106*a* of the heat release plate 106 by a two-sided adhesive tape or the like.

Above the heat release plate 106 in the Z direction of the head substrate 110, a guide slope portion 104 is formed along the longitudinal direction of the heat release plate 106. When the cover frame 12 shown in FIG. 4 is closed, the platen 71 slides along the guide slope portion 104 and is guided to a predetermined position. At this time, the inclination of the guide slope portion 104 is at a predetermined angle such that the platen 71 does not collide against the head substrate 110. The slope of the guide slope portion 104 substantially has the same height as the head substrate 110 provided near the guide slope portion 104. The head support shaft 102 is a columnar round pin and is pressed into holes provided at the left and right lateral portions of the heat release plate 106. The FPC 108 has one end connected to a connection terminal (not shown) provided in the head substrate 110 and the other end connected to a relay portion 95 shown in FIG. 4. The relay portion 95 has a function of collecting wires of the printer main body section 180 and the like and connecting the wires and the data storage device 300.

The head holding mechanism 77 shown in FIG. 4 includes a cutout portion 62 serving as a groove portion formed in the main body frame 60, a head pressing plate 72, and a spring 75 attached to the head pressing plate 72. The cutout portion 62 has an opening upward of the main body frame 60 and is formed with a plurality of groove portions. The thermal head 10 is attached to the main body frame 60 by inserting the head support shaft 102 into a part of the cutout portion 62 of the main body frame 60. The head pressing plate 72 is formed with bent portions at its upper and lower parts, and a spring 75 which is a compressed coil spring is fixed to the head pressing plate 72. The head pressing plate 72 is inserted into the cutout portion 62 and attached to the main body frame 60 by engaging the bent portions with a part of the cutout portion 62.

When this happens, the thermal head 10 and the head pressing plate 72 are supported on both sides of the cutout portion 62 in a state of being substantially parallel to each other. The spring 75 fixed to the head pressing plate 72 comes into contact with the rear surface of the thermal head 10. The spring 75 urges the thermal head 10 toward the platen 71. The head holding mechanism 77 can be disengaged from the cutout portion 62 by displacing the spring 75 fixed to the head pressing plate 72 from the rear surface of the thermal head 10. The urging force of the spring 75 is eliminated, thus the thermal head 10 can also be disengaged from the cutout portion 62. Thus, the thermal head 10 is detachably supported with respect to the main body frame 60.

As shown in FIGS. 2 and 4, the platen 71 is formed of an elastic member, such as rubber, in a cylindrical roller shape, and is rotatably supported by the cover frame 12 through platen bearings 73. A platen gear 74 is pressed into one shaft of the platen 71. The main body frame 60 is provided with groove portions 64. If the cover frame 12 is closed, the platen 71 is guided to the guide slope portion 104 (see FIG. 5) of the thermal head 10 and the platen bearings 73 come into contact with the groove portions 64. A downward force is applied to the cover frame 12 because of a pressing force of the thermal head 10 against the platen 71, such that the position of the platen 71 is determined.

With the above-described configuration, as shown in FIG. 4, the platen 71 presses the thermal sheet S from the inner surface S2 of the thermal sheet S toward the thermal head 10. The thermal head 10 which faces the platen 71 presses the thermal sheet S from the outer surface S1 of the thermal sheet S toward the platen 71. Thus, the thermal sheet S is sandwiched between the platen 71 and the thermal head 10. At this time, the above-described coloring layer is formed on the outer surface S1 of the thermal sheet S. As shown in FIG. 2, a sheet feed motor 66 and a sheet feed transmission gear 67 for rotating the platen 71 are provided at the lateral surface of the main body frame 60. As described above, the platen 71 is positioned in the groove portions 64 of the main body frame 60, such that the platen gear 74 and the sheet feed transmission gear 67 are meshed with each other and power from the sheet feed motor 66 is transmitted to the platen 71.

In the thermal printer 100 configured as above, the cover frame 12 connected to the upper cover 220 is opened, the roll sheet R which is the thermal sheet S is set, the thermal sheet S is pulled out to the sheet outlet port G, and the cover frame 12 connected to the upper cover 220 is closed. Thus, the thermal sheet S is set between the platen 71 and the thermal head 10 and between the movable blade 21 and the fixed blade 27. The sheet feed motor 66 is activated to rotate the platen 71 and to feed the thermal sheet S. Electrical conduction is selectively provided to the heat generation elements 145 arranged linearly in the thermal head 10 to generate heat, such that predetermined information can be printed on the thermal sheet S. The cutter section 20 is driven to reciprocate the movable blade 21 with respect to the fixed blade 27. Thus, the thermal sheet S with information printed thereon can be cut at a predetermined length and issued as a single sheet, such as a receipt.

(Overall Configuration of Data Storage Device)

Figure 6A:
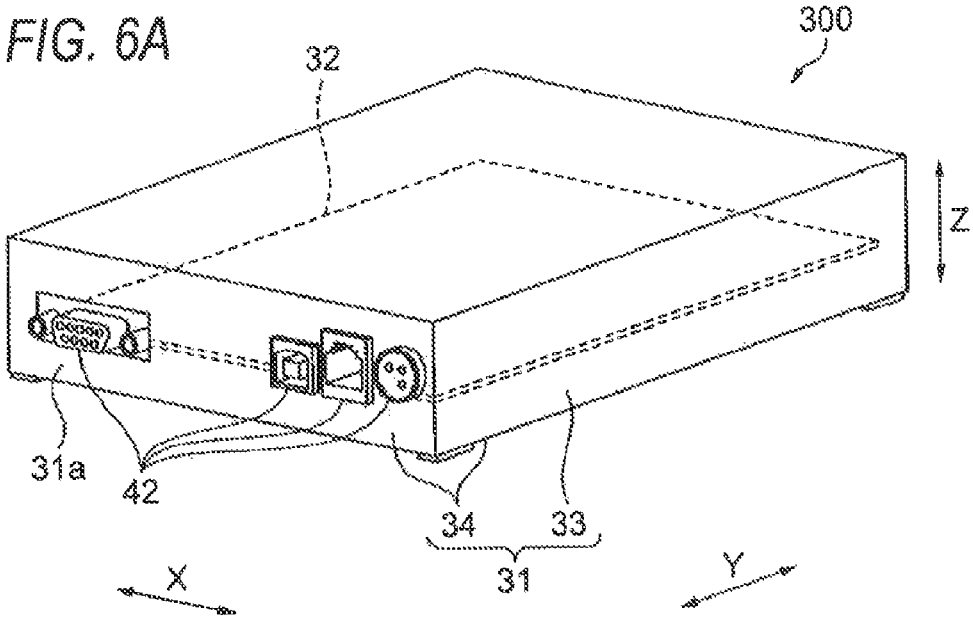
FIGS. 6A and 6B are diagrams showing the exterior of a data storage device.
Figure 6B:
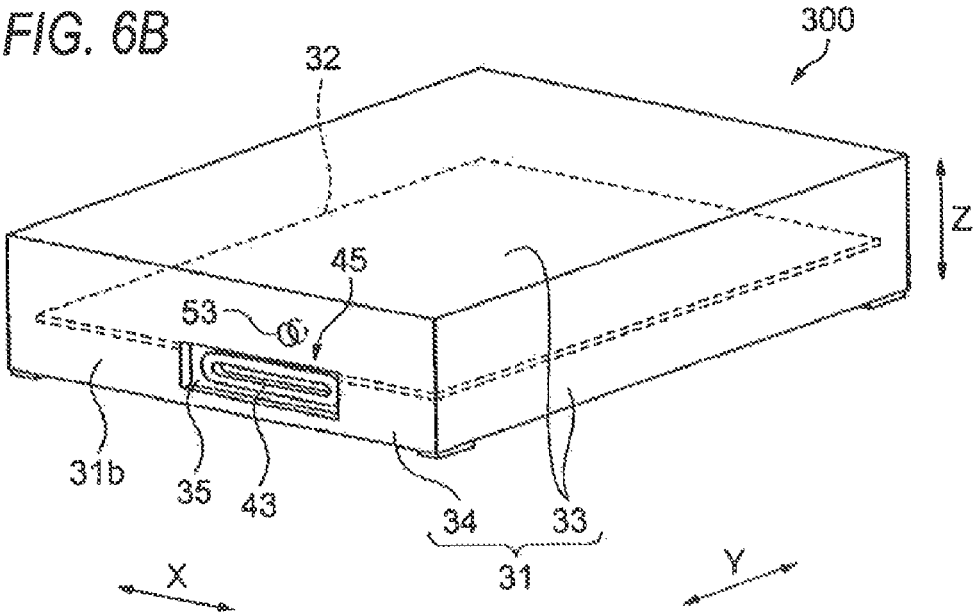
Figure 7:
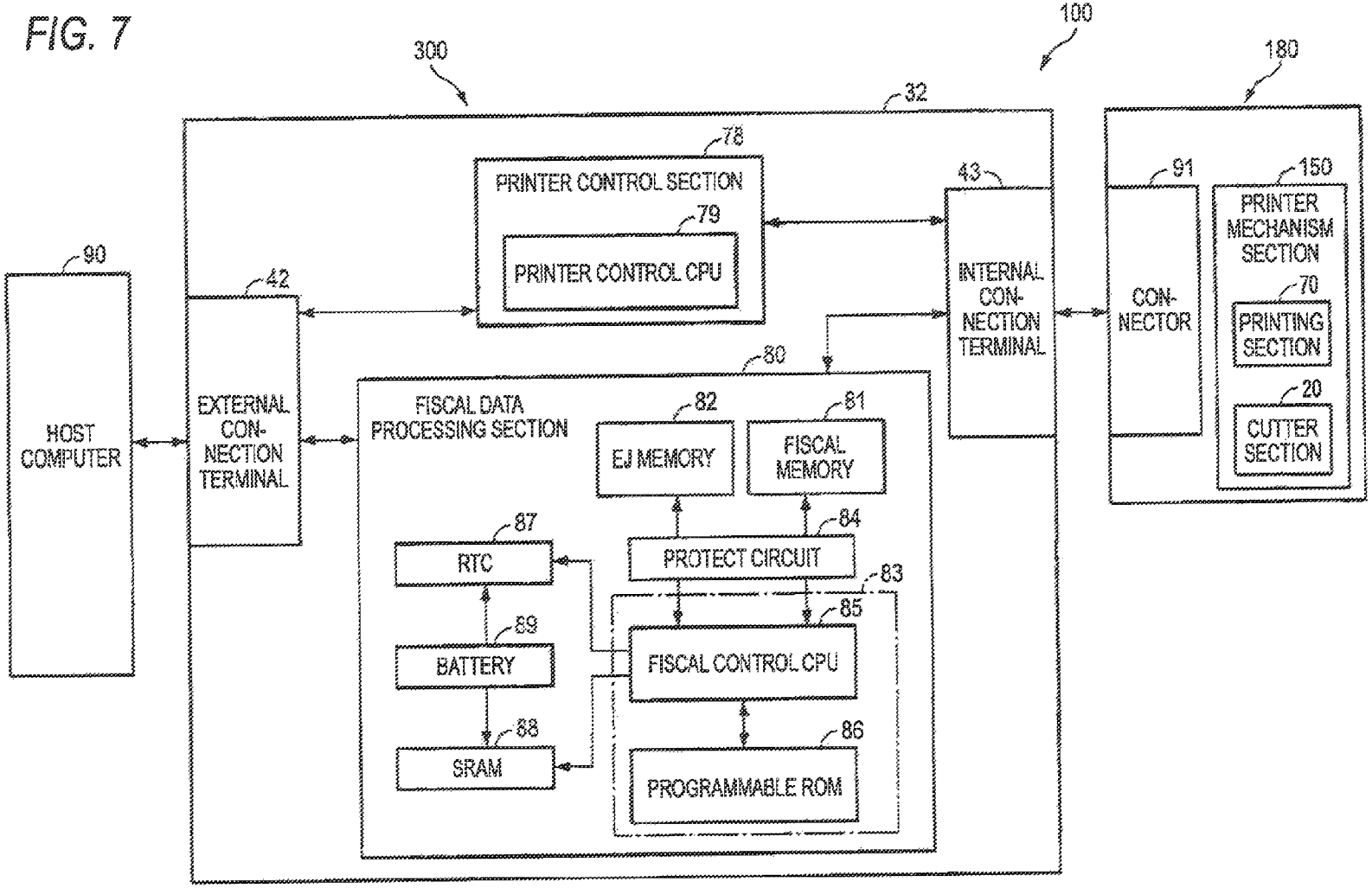
FIG. 7 is a block diagram showing the configuration of a data storage device and a printer main body section.

The overall configuration of the data storage device will be described with reference to FIGS. 6A, 6B, and 7. FIGS. 6A and 6B are diagrams showing the exterior of the data storage device. FIG. 6A is a perspective view when viewed from an external connection terminal. FIG. 6B is a perspective view when viewed from an internal connection terminal. FIG. 7 is a block diagram showing the configuration of the data storage device and the printer main body section. The X direction, the Y direction, and the Z direction shown in FIGS. 6A and 6B are respectively the same as the X direction, the Y direction, and the Z direction shown in FIGS. 1 to 4.

The data storage device 300 of this embodiment has a substrate on which a driving circuit of the thermal printer 100 and an electronic component, such as a fiscal memory which stores accounting information as data, are mounted. The thermal printer 100 (also referred to as a fiscal printer) individually prints and issues a receipt which is delivered to a customer at the time of a commercial transaction, such as a sale, the breakdown of a receipt for a seller, or a journal on which accounting information, such as the total sales amount and the total amount per product item, is recorded. The thermal printer 100 is driven tinder the control of the driving circuit.

The fiscal memory stores information regarding tax (hereinafter, referred to as fiscal data) from the accounting information. Fiscal data is used, for example, to secure taxation and, as necessary, a government inspector reads and inspects fiscal data. It is necessary that fiscal data stored in the fiscal memory cannot be falsified. For this reason, the specification of the data storage device 300 is strictly restricted in accordance with the law (fiscal law). For example, there are restrictions on prohibiting the data storage device 300 which has been connected to the printer main body section 180 from being easily separated, and on prohibiting the data storage device 300, which has been unauthorizedly separated, from being reconnected and the like. The contents of the fiscal law and the definition of fiscal data differ between countries.

As shown in FIGS. 6A and 6B, the data storage device 300 includes a main body case 31, a main substrate 32, external connection terminals 42, an internal connection terminal 43, and a shield plate actuation mechanism 45. The main body case 31 includes a substantially rectangular boxlike first case 33 with an opened bottom surface and a second case 34 forming the bottom surface thereof, and has a rectangular box shape. At one lateral surface 31*a* of the main body case 31 shown in FIG. 6A, the connection portions of the external connection terminals 42 are exposed. At the other lateral surface 31*b* of the main body case 31 shown in FIG. 6B, an opening 35 is provided and the internal connection terminal 43 is arranged behind the opening 35 such that the connection portion thereof turns outward. The shield plate actuation mechanism 45 is provided in the vicinity of the opening 35 and the connection portion of the internal connection terminal 43. The main substrate 32 is accommodated in the main body case 31. The details of the main substrate 32 and the shield plate actuation mechanism 45 will be described below.

The law (fiscal law) demands that the main body case 31 is structured such that it is not easily disassembled and, when the main body case 31 is disassembled without permission, the history of the disassembling is retained. Although in this embodiment, there is no particular limitation, in assembling the first case 33 and the second case 34, the first case 33 and the second case 34 may be fastened to each other by using a special tool, may be fixed to each other by using a tap having an irreversible structure, or may be fixed to and assembled with each other by a seal material or an adhesive.

(Main Substrate)

Next, the main substrate will be described with reference to FIG. 7. As shown in FIG. 7, the main substrate 32 includes a printer control section 78, a fiscal data processing section 80, an external connection terminal 42, and an internal connection terminal 43. The printer control section 78 includes a printer control CPU (Central Processing Unit) 79, an information processing section (not shown), a driver (not shown) which drives the thermal head or various motors, and the like. The printer control CPU 79 performs various kinds of processing, such as input signal processing from an operation section or detection section (not shown) and printing processing, to perform overall control of the printer main body section 180 (thermal printer 100).

The fiscal data processing section 80 includes a fiscal memory 81, an EJ (Electrical Journal) memory 82, a fiscal control section 83, a protect circuit 84, an RTC (Real Time Clock) 87, an SRAM (Static Random Access Memory) 88, and a battery 89. For the fiscal memory 81, a memory, called a random ROM (Read Only Memory), is used in which data can be written into one address once only. The fiscal memory 81 stores fiscal data regarding tax, such as the total sales amount. The EJ memory 82 is an electronic journal memory and stores individual sales data by using a nonvolatile memory device, such as a NAND-type flash memory.

The fiscal control section 83 includes a fiscal control CPU 85 and a programmable ROM 86. The fiscal control CPU 85 performs overall control of the fiscal data processing section 80 and processes data, such as accounting information. The programmable ROM 86 is a device into which a programmable logic circuit is written and controls writing, reading, or the like with respect to the fiscal memory 81. The protect circuit 84 has a function of preventing unauthorized access or falsification of data stored in the fiscal memory 81 or the EJ memory 82.

The RTC 87 is a real-time clock and is an IC which counts data and time. The SRAM 88 functions as a working memory to temporarily store various kinds of data, such as fiscal data or to temporarily expand a program of data processing or the like which is executed by the fiscal control CPU 85. The SRAM 88 has a battery backup function and uses the battery 89 as a power source. The battery 89 also supplies electricity to the RTC 87 and counts time even in a state where the main power source is shut off.

The external connection terminal 42 has a plurality of ports, connects a host computer 90, the printer control section 78, and the fiscal data processing section 80, and performs transmission/reception of commands or data with the host computer 90. The external connection terminal 42 has a fiscal port which is used only when the government inspector reads fiscal data of the fiscal memory 81. The internal connection terminal 43 is constituted by a single connector, and is connected to a connector 91 provided in the printer main body section 180 including the printer mechanism section 150 to transmit printing data or the drive signals to various mechanisms or to receive a sensor detection signal from the printer main body section 180. The internal connection terminal 43 includes an electronic switch (not shown). The electronic switch electrically detects that the data storage device 300 is separated from the printer main body section 180 and sends a signal to the RTC 87. The RTC 87 obtains the time at which the signal is received, sends the result to any available memory, and stores the result in the memory.

In the data storage device 300 configured as above, printing data including a command sent from the host computer 90 and accounting information is processed by the printer control section 78, and printed on the thermal sheet S and issued as a receipt by the printer main body section 180. In the data storage device 300, printing data is processed by the fiscal data processing section 80 to extract necessary data from printing data and to sequentially store necessary data in the EJ memory 82. The EJ memory 82 accumulates such data for each receipt. Fiscal data related to tax is selected from printing data or data which is temporarily stored in the SRAM 88 and stored in the fiscal memory 81. At this timed, as necessary, temporal information is given by the RTC 87. The selection and processing are controlled by the fiscal control CPU 85 using a program which is mainly stored in the programmable ROM 86.

The law (fiscal law) demands that it is possible to prohibit easy access to the fiscal memory 81 or the EJ memory 82 and, when access is made, the history of the access is retained. For this reason, the protect circuit 84 is provided in front of the fiscal memory 81 and the EJ memory 82, and for example, access is permitted only on the basis of a permission signal sent from the fiscal control CPU 85. The specification of the protect circuit 84 is not particularly limited. A microcomputer or a CPLD (Complex Programmable Logic Device) may be used.

When the government inspector reads fiscal data of the fiscal memory 81 for inspection, for example, confidential ID information is used and a dedicated fiscal port is used. The fiscal control CPU 85 recognizes the ID information and sends a reading permission signal of the protect signal 84 to permit access to the fiscal memory 81. As necessary, access to the EJ memory 82 is permitted. The access history is given temporal information by the RTC 87 and stored in the fiscal memory 81.

(Shield Plate Actuation Mechanism)

Figure 8A:
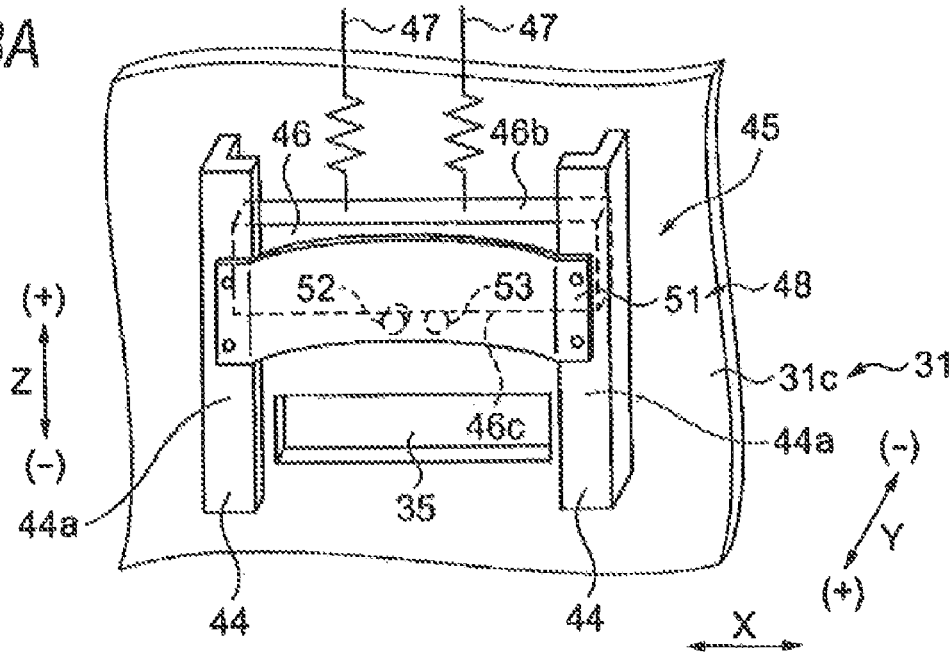
FIGS. 8A to 8C illustrate a shield plate actuation mechanism.
Figure 8B:
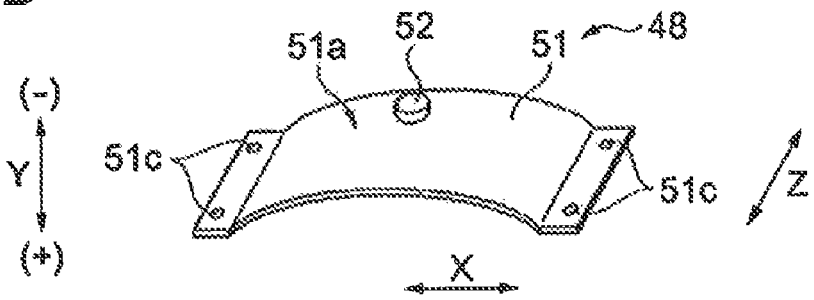
Figure 8C:
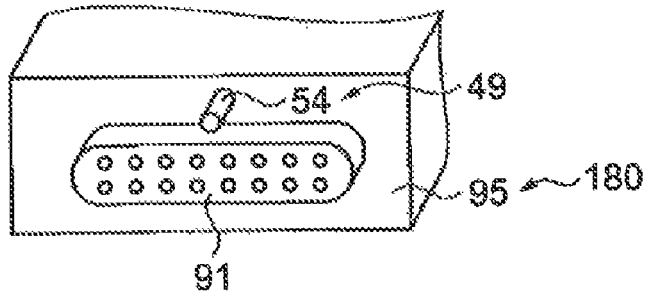
Figure 9A:
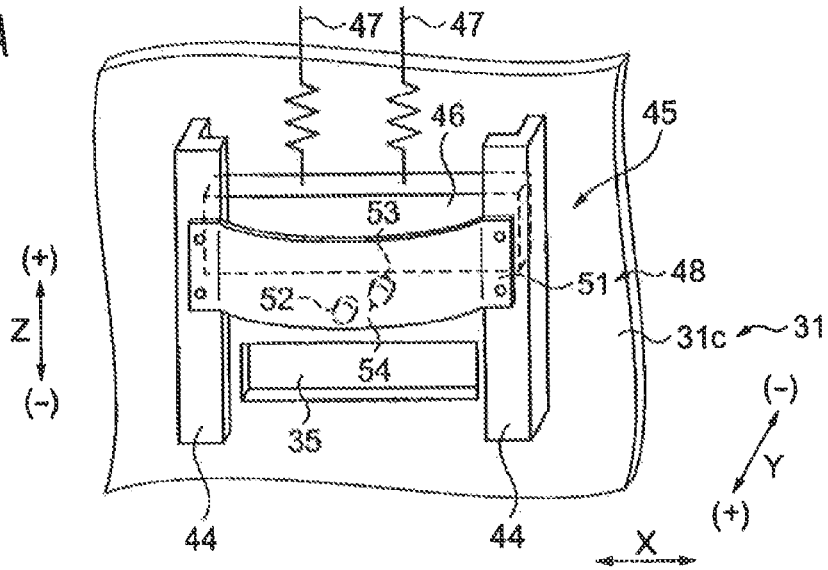
FIGS. 9A and 9B are diagrams illustrating the operation of the shield plate actuation mechanism.
Figure 9B:
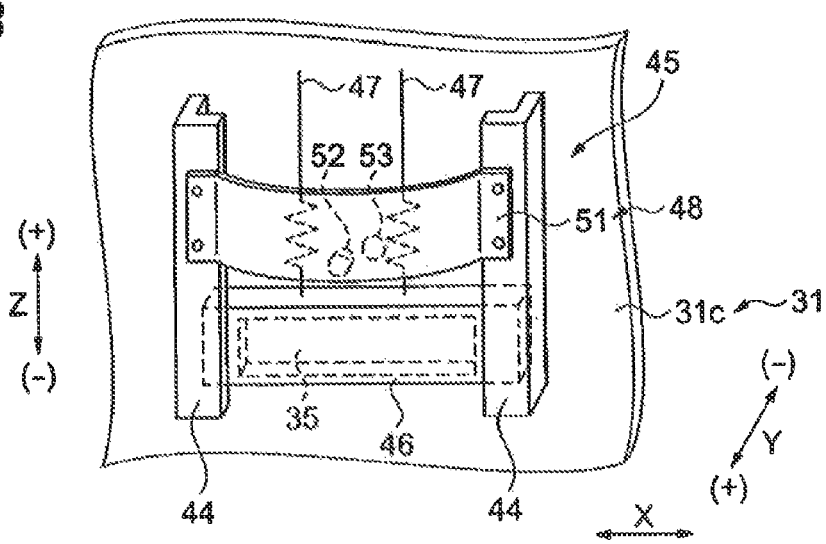
Figure 10:
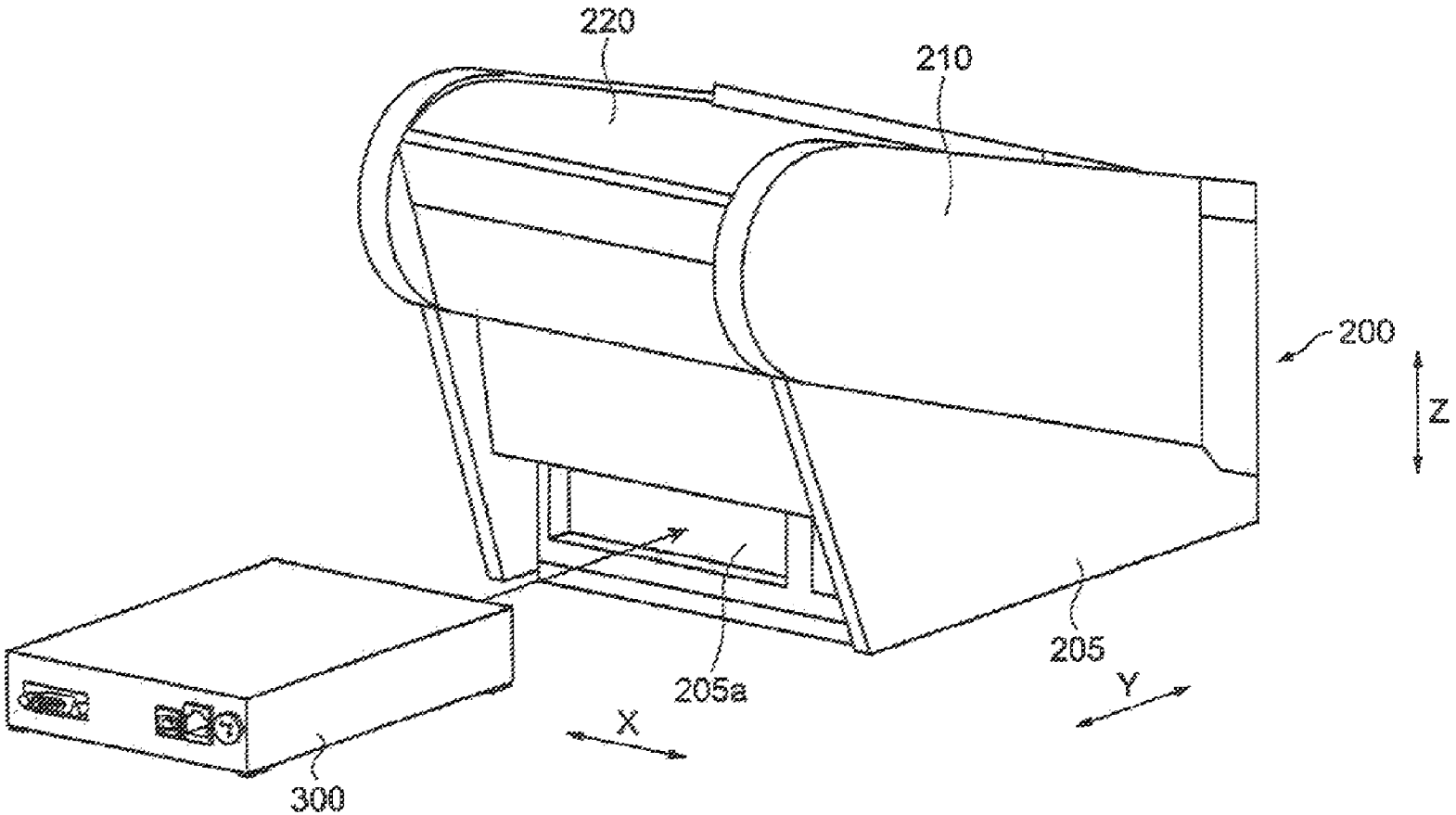
FIG. 10 is a perspective view showing the relationship between the data storage device and the printer main body section.

Next, the shield plate actuation mechanism will be described with reference to FIGS. 8A to 10. FIGS. 8A to 8C are diagrams illustrating the shield plate actuation mechanism. FIG. 8A is a perspective view of the shield plate actuation mechanism in the initial state when viewed from the inner surface of the main body case. FIG. 8B is a perspective view of a plate spring serving as urging means. FIG. 8C is a perspective view of the periphery of the receiving terminal of the relay portion. FIGS. 9A and 9B are diagrams illustrating the operation of the shield plate actuation mechanism. FIG. 10 is a perspective view showing the relationship between the data storage device and the printer main body section. The X direction, the Y direction, and the Z direction shown in FIGS. 8A to 10 are respectively the same as the X direction, the Y direction, and the Z direction shown in FIGS. 1 to 4.

As shown in FIGS. 8A, 8B, and 8C, the shield plate actuation mechanism 45 includes a shield plate 46, a spring 47 serving as urging means, a shield plate guide 44, first shield plate locking means 48, and second shield plate locking means 49. The shield plate actuation mechanism 45 is arranged in the periphery of the opening 35 of the inner surface 31*c* of the main body case 31.

The shield plate 46 is formed in a flat plate shape having a size such that the opening 35 of the main body case 31 is shielded. Both ends of the shield plate 46 are guided by L-shaped shield plate guides 44 arranged on both sides of the opening 35, and the shield plate 46 is arranged to be movable in the Z direction. An upper side 46*b* of the shield plate 46 is urged by the spring 47 which is a compressed coil spring and is applied with a spring force in the Z(−) direction. A lower side 46*c* of the shield plate 46 is locked to a first locking pin 52 of the first shield plate locking means 48 described below.

As shown in FIG. 8B, the first shield plate locking means 48 has an elastic plate-shaped member, for example, a first locking plate 51 formed of a plate spring. The first locking plate 51 has a central portion which is formed in an arc shape in the Y(−) direction, and the first locking pin 52 is provided at the central portion of an arc-shaped surface 51*a*. The first locking pin 52 may be embedded with a columnar pin or may be formed in a convex shape by drawing. Both ends of the first locking plate 51 in the X direction are formed in a flat plate shape, and attachment holes 51*c* are formed to which the shield plate guides 44 are attached. The first locking plate 51 is attached to the surfaces 44*a* of the shield plate guides 44 such that the first locking pin 52 and the arc-shaped surface 51*a* are opposite the shield plate 46. An attachment method may be thermal caulking or fastening using screws.

As shown in FIGS. 6B and 8A, the main body case 31 is formed with a through hole 53 which passes therethrough to the outer surface in the vicinity of a position where the first locking pin 52 of the first locking plate 51 is arranged. In the initial state shown in FIG. 8A, the shield plate actuation mechanism 45 structured as above can put the opening 35 of the data storage device 300 in the open state by locking the shield plate 46 which is urged in the Z(−) direction by the spring 47 and applied with a spring force, to the first locking pin 52 of the first locking plate 51.

As shown in FIG. 8C, the second shield plate locking means 49 is provided near the connector 91 of the relay portion 95 in the printer main body section 180. The second shield plate locking means 49 includes a second locking pin 54. The position of the second locking pin 54 corresponds to the position of the through hole 53 provided in the main body case 31 when the printer main body section 180 and the data storage device 300 are connected to each other by the internal connection terminal 43 and the connector 91.

Next, the operation of the shield plate actuation mechanism will be described with reference to FIGS. 8A to 10. As described above, FIG. 8A shows the initial state, that is, the state before the data storage device 300 is connected to the printer main body section 180. FIG. 9A shows the state where the data storage device 300 is connected to the printer main body section 180. FIG. 9B shows the state after the data storage device 300 is separated from the printer main body section 180. The description of FIG. 8A will be omitted.

As shown in FIG. 10, the data storage device 300 is inserted from an insertion port 205*a* formed at the rear of the lower case 205 of the exterior case 200, and the single internal connection terminal 43 is connected to the single connector 91 arranged in the relay portion 95 of the printer main body section 180. At this time, as shown in FIG. 9A, the second locking pin 54 is inserted into the through hole 53 of the main body case 31. The inserted second locking pin 54 presses the periphery of the central portion of the surface 51*a* of the first looking plate 51 of the first shield plate locking means 48 in the inward direction, that is, in the Y(+) direction. The first locking plate 51 has the central portion which is formed of a plate spring curved in an arc shape in the Y(−) direction. Thus, if the first locking plate 51 is pressed at a predetermined distance, the arc portion which is curved in the Y(−) direction is curved in the Y(+) direction.

For this reason, the first locking pin 52 of the first locking plate 51 moves in the Y(+) direction. The shield plate 46 which is locked to the first locking pin 52 is unlocked, such that the shield plate 46 is urged by the spring 47 and moves in the Z(−) direction. Meanwhile, the movement of the shield plate 46 which has tried to move is inhibited by the second locking pin 54 serving as the second shield plate locking means 49 inserted in the through hole 53 in the movement area and locked to the second locking pin 54. For this reason, while the data storage device 300 is initially connected to the printer main body section 180 and functions as the thermal printer 100, the shield plate 46 is locked to the second locking pin 54, such that the opening 35 is kept in the open state.

As shown in FIG. 9B, if the data storage device 300 is disconnected from the printer main body section 180, the second locking pin 54 provided in the printer main body section 180 is removed from the through hole 53 of the main body case 31. The shield plate 46 which is urged in the Z(−) direction by the spring 47 and locked to the second locking pin 54 is unlocked and moves in the Z(−) direction. The shield plate 46 moves up to the opening 35 of the main body case 31 and shields the opening 35. For this reason, the connection portion of the internal connection terminal 43 arranged behind the opening 35 of the main body case 31 is shielded by the shield plate 46, such that connection from the outside is impossible.

Hereinafter, the advantages of the embodiment will be described.

The law (fiscal law) demands that the data storage device 300 is structured so as to be not easily disconnected from the printer main body section 180, and when the data storage device 300 is disconnected without permission, the history of the disconnection is retained, unauthorized access to the fiscal memory 81 is impossible, and reconnection is impossible after data falsification.

The above-described data storage device 300 is structured such that the internal connection terminal 43 which is connected to the connector 91 of the printer main body section 180 is arranged inside the main body case 31, and the connection portion is exposed from the opening 35 of the main body case. The data storage device 300 has the shield plate 46 which shields the opening. The shield plate 46 can be actuated by the above-described shield plate actuation mechanism 45.

Specifically, in the initial state, the shield plate 46 is locked to the first locking pin 52 of the first shield plate locking means 48, and the opening 35 is in the open state. When the data storage device 300 is connected to the printer main body section 180, the shield plate 46 is unlocked from the first locking pin 52 of the first shield plate locking means 48 and locked to the second locking pin 54 of the second shield plate locking means 49 provided in the printer main body section 180. When the data storage device 300 is separated from the printer main body section 180, the shield plate 46 is unlocked from the second locking pin 54 of the second shield plate locking means 49 provided in the relay portion 95 of the printer main body section 180 and shields the opening 35 of the data storage device 300.

That is, the internal connection terminal 43 serving as the connection terminal of the data storage device 300 can be hidden. For this reason, it is possible to prevent unauthorized access from the internal connection terminal 43 of the data storage device 300. Disconnection of the data storage device 300 can be obviously known, and then reconnection is impossible. As a result, it is possible to prevent the data storage device 300 from being easily disconnected from the printer main body section 180. Therefore, the risk of unauthorized access or data falsification is reduced, providing the high-reliability data storage device 300.

Although the embodiment of the invention has been described, various modifications may be made from the embodiment without departing from the spirit and scope of the invention. For example, the modifications other than the embodiment are as follows.

(Modification 1) Although in the above-described embodiment, a case has been described where the shield plate 46 is guided by the shield plate guides 44 and slides, the invention is not limited thereto. The rotation center constituted by a hole and a pin may be provided at a part of the shield plate 46. The rotation direction may be the direction parallel to the inner surface 31*c* of the main body case 31, and the shield plate 46 may slide. The rotation direction may be the direction perpendicular to the inner surface 31*c* of the main body case 31, and the shield plate 46 may operate to open/close the opening 35. The spring serving as urging means is not limited to a compressed coil spring, a tension coil spring, or a torsion coil spring. Any spring may be used insofar as a predetermined urging force can be given.

(Modification 2) Although in the above-described embodiment, a case has been described where the first locking plate 51 of the first shield plate locking means 48 is the plate spring which is formed in an arc shape with both ends fixed, the invention is not limited thereto. The first locking plate 51 may have a function of being deformed in the direction opposite to the locking direction of the first locking pin 52 with the progress of the second locking pin 54, and may be, for example, a cantilevered plate member or a spring, such as a torsion spring. The first shield plate locking means 48 and the second shield plate locking means 49 may be provided with a locking member or a relay member halfway due to the spatial restrictions of the installation place.

What is claimed is:

1. A data storage device, comprising:

a substrate on which at least a storage section configured to store information therein and a connection terminal configured to transmit information are mounted;

a casing accommodating the substrate, the easing formed with an opening to expose a connection portion of the connection terminal to the outside;

a shield plate configured to shield the opening of the casing; and a shield plate actuation mechanism configured to detect a connection state between the connection terminal and a receiving terminal to which the connection terminal is connected and actuate the shield plate, wherein the shield plate actuation mechanism actuates the shield plate to shield the opening when the shield plate actuation mechanism detects that the connection terminal is separated from the receiving terminal, wherein the shield plate actuation mechanism includes:

the shield plate;

an urging member that urges the shield plate in one direction;

a first shield plate locking member that locks the movement of the shield plate; and a second shield plate locking member that releases locking of the first shield plate locking member and locks the movement of the shield plate when the shield plate actuation mechanism detects that the connection terminal is connected to the receiving terminal.

2. The data storage device as set forth in claim 1, wherein the second shield plate locking member is provided at a side of the receiving terminal.

3. A printing apparatus, comprising:

a printing section configured to print the information on a recording sheet;

a main body section including at least the printing section; and the data storage device as set forth in claim 1, wherein the main body section has the receiving terminal and the data storage device is connected to the printing apparatus through the connection terminal and the receiving terminal.

4. The printing apparatus as set forth in claim 3, wherein the data storage device further comprises a control section configured to control the main body section, inside the casing.

* * * * *